US005410947A

United States Patent [19]

Garnjost

[11] Patent Number: 5,410,947

[45] Date of Patent: May 2, 1995

[54] VOLUME-COMPENSATED LOW-WEAR RECIPROCATING SEAL ASSEMBLIES

[75] Inventor: Kenneth D. Garnjost, Buffalo, N.Y.

[73] Assignee: Moog Inc., East Aurora, N.Y.

[21] Appl. No.: 123,526

[22] Filed: Sep. 17, 1993

[51] Int. Cl.[6] ..... F15B 21/04

[52] U.S. Cl. ..... 92/80; 92/82; 92/86; 92/168; 92/60

[58] Field of Search ..... 92/80, 82, 86, 168, 92/60

[56] References Cited

U.S. PATENT DOCUMENTS

| | | | |
|---|---|---|---|
| 2,194,209 | 3/1940 | Mott | 92/82 |
| 2,683,467 | 7/1954 | Greer | 92/82 |
| 2,974,636 | 3/1961 | Farmer | 92/86 |
| 3,293,994 | 12/1966 | Napolitano | 92/86 |
| 3,584,331 | 6/1971 | D'Hooge | 92/86 |
| 3,905,278 | 9/1975 | Ourdouillie | 92/80 |
| 4,597,322 | 7/1986 | Garnjost et al. | 92/80 |

*Primary Examiner*—Thomas E. Denion
*Attorney, Agent, or Firm*—Phillips, Lytle, Hitchcock, Blaine & Huber

[57] ABSTRACT

A fluid-powered actuator (42) has a body (11) which includes an end wall (16) provided with a through-opening (21). A piston rod (44) has an inner portion (44A) arranged on one side of the end wall within a pressurizable working chamber (24) of the actuator, has a penetrant portion (44B) passing through the end wall opening, and has an outer portion (44C) arranged on the other side of the end wall. The rod is configured such that the transverse cross-sectional area of the penetrant portion is greater than the transverse cross-sectional area of the outer portion so as to define an annular surface (46) which faces away from the actuator chamber. The improvement provides a seal assembly (43) for containing fluid leaking from the actuator chamber. The seal assembly includes a sliding-seal member (30) sealingly mounted on the rod outer portion for movement therewith and for sliding movement relative thereto toward and away from the actuator surface, and a metal bellows (38) joining the body and the sliding-seal member and defining between the body the sliding-seal member and the rod a leakage chamber (48) surrounding the end wall opening. The rod and bellows are so dimensioned, configured and arranged relative to one another such that equal small-amplitude movements of the rod and sliding-seal member relative to the body will not substantially change the volume of the leakage chamber. The improved seal assembly may therefore accommodate such small-amplitude movements of the rod relative to the body without causing the sliding-seal member to move relative to the rod.

12 Claims, 1 Drawing Sheet

VOLUME-COMPENSATED LOW-WEAR RECIPROCATING SEAL ASSEMBLIES

TECHNICAL FIELD

The present invention relates generally to the field of seal assemblies for fluid-powered actuators, and, more particularly, to improved volume-compensated seal assemblies which arc operatively arranged to cause a flexibly-supported sliding-seal member to move with the actuator rod during small-amplitude reciprocating motion of the rod, so as to minimize wear.

BACKGROUND ART

Many forms of fluid-powered actuators have been heretofore developed. The most common of these has a piston slidably mounted within a cylinder. A rod typically penetrates an end wall of the cylinder and is connected to the piston, such that the piston and rod move together as a unit. Generally, the portion of the rod which is arranged within the piston end chamber will be exposed to a pressure greater that the distal end of the rod, which is arranged on the other side of the wall penetrated by the rod. Because of the pressure differential which may be encountered across such wall, fluid will tend to leak from the piston end chamber between the wall opening and the penetrant portion of the rod passing therethrough.

It has been known to provide resilient seals between the rod and the wall opening to substantially reduce the amount of fluid leakage therebetween. It has also been known to provide a closely-fitted rod through a wall opening having certain axially-spaced grooves in the marginal portion about the opening. This is known as a "laminar seal" because it has the characteristics of relatively-low, laminar leakage, and has a very long life.

However, in some situations, the actuator rod must operate in a cyclical or harmonic manner over long periods of time. In these applications, it would be desirable that the rod seal have an extremely long endurance life and substantially zero leakage. Typical elastomeric or plastic seals will not afford the required life, and closely-fitted, lapped, metal-to-metal seals, which can meet the life requirements, typically exhibit unacceptable rates of leakage.

U.S. Pat. No. 4,597,322, the aggregate disclosure of which is hereby incorporated by reference, discloses two different types of seal assemblies for controlling the leakage flow of pressurized fluid from such a fluid-powered actuator. A first form of actuator of seal assembly is shown in FIGS. 1–4, and a second form is shown in FIGS. 5–8. The first form is shown as having a piston slidably mounted within a cylinder, and operatively arranged to subdivide the cylinder into opposed pressurizable chambers. Rods issue leftwardly and rightwardly from the piston, and penetrate the opposite end walls of the cylinder. High-pressure laminar-type seals, having an alternating series of lands-and-grooves, are provided between the end walls and the penetrant rod portions. This first form is also shown as having a variable-volume leakage chamber arranged to the left of the left actuator chamber, to receive leakage flow therefrom. This leakage chamber is bounded by a sliding-seal member mounted on the rod outer portion, a flexible metal bellows connecting the sliding-seal member to the body, and a coil spring acting between the body and the sliding-seal member, and urging it to move rightwardly into engagement with an annular abutment surface provided on the rod. This leakage chamber communicates with fluid return via a check valve.

The second form, shown in FIGS. 5–8 of the '322 patent, is generally similar except that the coil spring and abutment surface are omitted. In lieu thereof, a frictional member is additionally mounted on the inner surface of the sliding-seal member to increase the frictional resistance with the rod outer portion.

In either case, the sliding-seal member is intended to move with the rod during small-amplitude motions of the rod relative to the body. However, in both forms, the volume of the leakage chamber varies as a function of the position of the rod and the sliding-seal member relative to the body. If the rod and sliding-seal member move in one direction, the volume of the leakage chamber will increase. Conversely, if the rod and sliding-seal member move in the opposite direction, the volume of the leakage chamber will decrease. These volumetric changes during operation cause the pressure of fluid within the leakage chamber to vary substantially, thus requiring a high level of friction between the sliding-seal member and the rod to cause the sliding-seal and rod to move together during such small-amplitude motions relative to the body.

Details of other seal assemblies which incorporate such a flexibly-mounted sliding seal intended to reciprocate with the actuator rod, are shown and described in U.S. Pat. No. 4,535,998, and in British Patent No. 1,269,055.

DISCLOSURE OF THE INVENTION

With parenthetical reference to the corresponding parts, portions or surfaces of the disclosed embodiment, merely for purposes of illustration and not by way of limitation, the present invention provides a significant improvement for use with a fluid-powered actuator (e.g., 42) having a body (e.g., 11) and rod (e.g., 44). The body has a portion configured as an end wall (e.g., 16) provided with a through-opening (e.g., 21). The rod has an inner portion (e.g., 44A) arranged on one side of the end wall within a pressurizable working chamber (e.g., 24) of the actuator, has a penetrant portion (e.g., 44B) passing through the end wall opening, and has an outer portion (e.g., 44C) arranged on the other side of the end wall. The rod is configured such that the transverse cross-sectional area of the penetrant portion is greater than the transverse cross-sectional area of the outer portion so as define an annular surface (e.g., 46) therebetween.

In one aspect, the invention provides an improved seal assembly (e.g., 43) for containing fluid leaking from the actuator chamber through the annular space between the rod penetrant portion and the wall opening. In this form, the seal assembly broadly includes: a sliding-seal member (e.g., 30) engaging the rod outer portion for sealed movement therewith and for sealed sliding movement therealong toward and away from the annular surface; a flexible closure (e.g., 38), such as a metal bellows, joining the body and the sliding-seal member and defining between the body, the sliding-seal member and the rod, a leakage chamber (e.g., 48) surrounding the end wall opening; and wherein the rod and flexible closure are so dimensioned, configured and arranged relative to one another such that equal small-amplitude movements of the rod and the sliding-seal member relative to the body will not substantially change the volume of the leakage chamber; whereby the seal assembly may accommodate such small amplitude movements of the rod relative to the body without causing the sliding-seal member to move relative to the rod.

In another aspect, the invention provides an improved seal assembly (e.g., 43) for containing fluid leaking from the actuator chamber through the annular space between the rod penetrant portion and the end wall opening. In this form, the improved seal assembly broadly includes: a sliding-seal member (e.g., 30) engaging the rod outer portion for sealed movement therewith and for sealed sliding movement therealong; and a flexible closure (e.g., 38) having one end connected to the body and having another end connected to the sliding-seal member to define between the body, the sliding-seal member and the rod a sealed chamber (e.g., 48) communicating with the end wall opening, the flexible closure being movable relative to the body within a displacement range; and wherein the rod is so configured, dimensioned and arranged relative to the flexible closure that the sliding-seal member does not substantially move relative to the rod during small-amplitude motion of the rod relative to the body.

In still another aspect, the invention broadly provides: an improved seal assembly (e.g., 43) having a high-pressure laminar-type seal arranged between the body and the rod penetrant portion, having a low-pressure resilient sliding-seal (e.g., 30) mounted on the rod outer portion, the low-pressure seal being connected to the body by a flexible bellows (e.g., 38) arranged to form a low-pressure leakage chamber (e.g., 48) surrounding the end wall opening and adapted to permit small-amplitude reciprocating motion of the sliding-seal member relative to the body within displacement limits; and wherein the rod has an annular surface (e.g., 46) facing into the low-pressure leakage chamber, this annular surface having an area substantially equal to the effective hydraulic pumping area between the bellows and the rod outer portion such that the sliding-seal will move with the rod within displacement limits with substantially no change in the volume of the low-pressure leakage chamber; whereby the sliding-seal will be hydrostatically urged to move with the rod within the displacement limits, but the rod will move relative to the sliding-seal if the amplitude of rod motion exceeds the displacement limits.

Accordingly, the general object of the invention is to provide an improved seal assembly for containing leakage flow from a pressurizable chamber of a fluid-powered actuator and which causes a flexibly-mounted sliding seal to move with small reciprocating motions of the piston rod to minimize seal wear.

Another object is to provide an improved seal assembly for use with a fluid-powered actuator, in which the volume of a leakage chamber does not change during equal small-amplitude movements of the rod and sliding-seal member relative to the body, whereby the sliding-seal member is positively driven hydrostatically by small amplitude rod movements.

Still another object is to provide an improved seal assembly which is volume-compensated for small-amplitude movements of a rod relative to the body, which may provide for volumetric change of a leakage chamber in the event of large-amplitude movements of the rod relative to the body.

These and other objects and advantages will become apparent from the foregoing and ongoing written specification, the drawings, and the appended claims.

DESCRIPTION OF THE PREFERRED EMBODIMENTS

Figure 1:
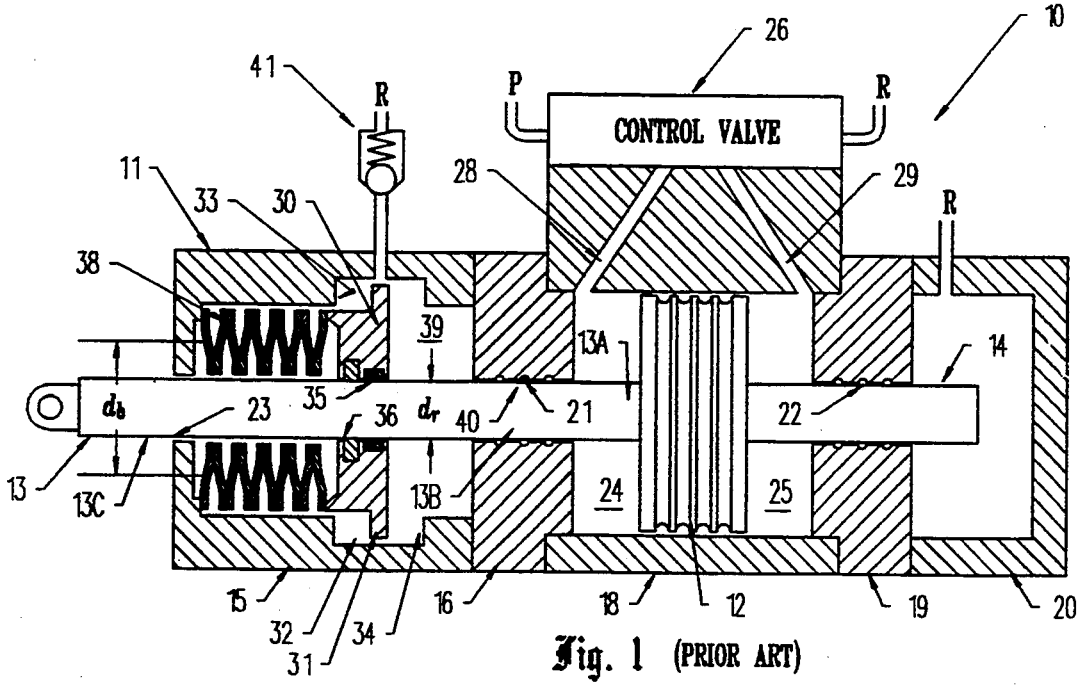
Fig. 1 (PRIOR ART)
FIG. 1 is a schematic fragmentary view, partly in vertical section and partly in elevation, of a prior art form of fluid-powered actuator with a seal assembly arranged to contain leakage flow from one of the pressurizable actuator chambers, this structure being substantially the second embodiment shown in U.S. Pat. No. 4,597,322.

At the outset, it should be clearly understood that like reference numerals are intended to identify the same structural elements, portions or surfaces consistently throughout the several drawing figures, as such elements, portions or surfaces may be further described or explained by the entire written specification of which this detailed description is an integral part. Unless otherwise indicated, the drawings are intended to be read (e.g., arrangement of parts, mounting, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.) simply refer to the orientation of the illustrated structure as the particular drawing figure faces the reader. Unless otherwise indicated, the terms "inwardly" and "outwardly" refer to the orientation of a surface relative to its axis of elongation, or axis or rotation, as appropriate.

Prior Art Seal Assembly (FIG. 1)

Referring now to the drawings, FIG. 1 depicts a prior art seal assembly associated with a fluid-powered actuator, such as shown in FIGS. 5–8 of U.S. Pat. No. 4,597,322. This prior art actuator, generally indicated at 10, is shown as having a horizontally-elongated multiple-piece cylinder body, generally indicated at 11; a piston 12 arranged within the cylinder; a left rod 13 mounted on the piston and extending leftwardly therefrom; and a right rod 14 mounted on the piston and extending rightwardly therefrom.

The body is shown as having five separate parts, severally indicated at 15, 16,18,19,20, respectively. Body parts 16 and 19 form the end walls of a cylinder, with intermediate part 18 forming the cylindrical side wall thereof. End walls 16 and 19 are shown as having axially-aligned through-openings 21,22, respectively. Body left part 15 is configured as a horizontally-elongated cup-shaped member having its rightward large-diameter mouth sealingly abutting the left face of body left end wall 16. The body left part 15 is also shown as having a leftward through-opening, indicated at 23, to accommodate passage of an outer portion of rod 13.

Piston 12 sealingly separate the cylinder into left and right opposed chambers 24,25, respectively, which are arranged to be supplied with fluid from a servo-valve 26 via passageways 28,29, respectively. Left rod 13 has an inner portion 13A arranged within actuator chamber 24, a penetrant portion 13B penetrating the left end wall opening 21, and an outer portion 13C arranged outside the actuator chamber.

A sliding-seal member, generally indicated at 30, is shown as being mounted on the rod outer portion 13C for movement therewith and for movement relative thereto. More particularly, this sliding-seal member is shown as being in the form of an annular disk-shaped element having a radially-extending annular flange 31 operatively arranged in a diametrically-enlarged portion 32 of body 15. This diametrically-enlarged portion 32 provides facing left and right displacement stops 33,34, respectively. The sliding-seal member has an O-ring 35 and a friction member 36 extending radially inwardly beyond its inner surface so as to frictionally engage rod outer portion 13C. Thus, the sliding-seal member is mounted on rod outer portion 13C for movement therewith and for movement relative thereto.

A flexible metal bellows 38 has its left end sealing secured to body left part 15, and has its right end sealing secured to the sliding-seal member. Thus, the bellows, the sliding-seal member, the body, and the rod outer portion define an external variable-volume leakage chamber 39 which communicates with opening 21. A bellows used as a seal will displace fluid equivalent to that displaced by a piston in a cylinder having a diameter somewhere between the inner and outer diameter of the bellows, the exact value being empirically determined by the particular configuration of the bellows convolutions. Thus, bellows 39 has an effective diameter $d_b$, and rod 13 has a diameter $d_r$. The bellows has an effective pumping area ($A_{bellows\ eff}$) equal to the transverse cross-sectional area of the bellows minus the transverse cross-sectional area of the rod. Or, $$A_{bellows\ eff} = \frac{\pi}{4} d_b^2 - \frac{\pi}{4} d_r^2 \quad [1]$$

$$= \frac{\pi}{4} [d_b^2 - d_r^2] \quad [2]$$

In this prior art arrangement, as the servovalve is operated to control the fluid with respect to opposed actuator chambers 24,25, piston 12 moves axially within the cylinder, thereby causing rod 13 to move axially relative to the left end wall. Highly-pressurized fluid in actuator chamber 24 can therefore leak through the annular space between the alternating series of lands-and-grooves, indicated at 40, provided on the left end wall and the penetrant portion of the rod, to enter leakage chamber 39. However, the volume of leakage chamber 39 varies as a function of the position of the sliding-seal member relative to the body. A check valve 41 communicates leakage chamber 39 to a fluid return R. Thus, when the pressure in chamber 39 exceeds the cracking pressure of check valve 41, fluid is permitted to pass through the check valve to return, to relieve the pressure in chamber 39. As indicated above, the sliding-seal member frictionally engages the rod, and therefore tends to move therewith between displacement limits 33,34. The frictional force of the sliding seal and friction member on the rod are designed to overcome the bellows reaction force, but if such frictional force between the sliding-seal member and the rod decreases with wear, or if the leakage chamber pressure becomes excessive, the sliding-seal member will not move reliably with the rod.

Figure 2:
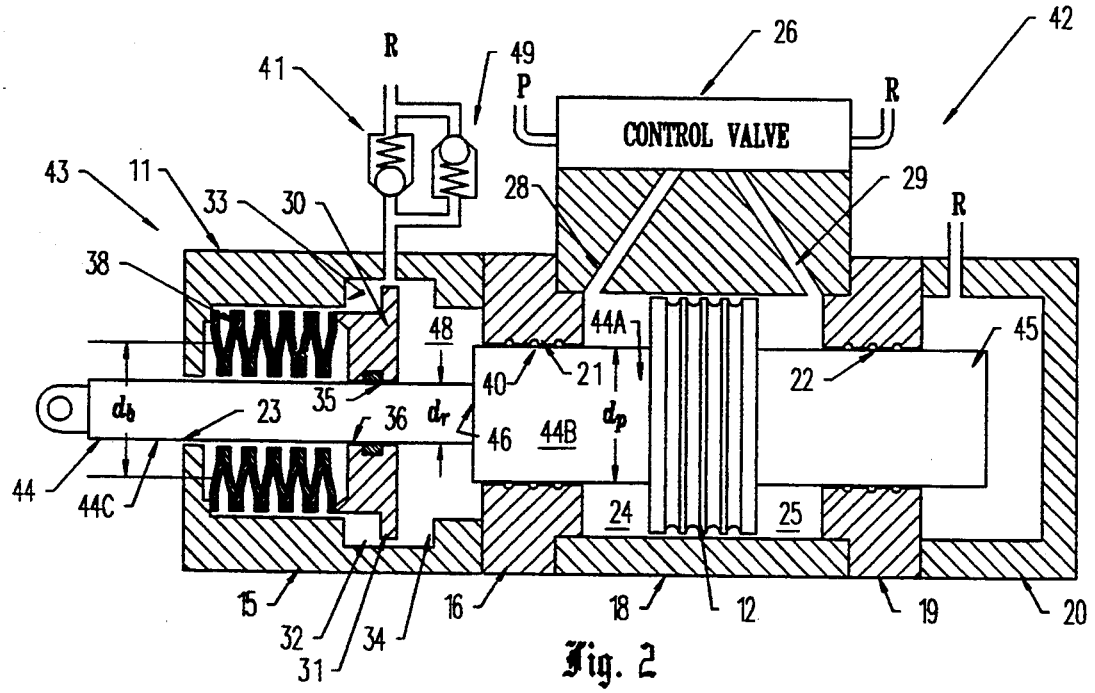
FIG. 2 is a schematic fragmentary view, partly in vertical section and partly in elevation, of an improved seal assembly associated with a fluid-powered actuator.

Improved Seal Assembly (FIG. 2)

FIG. 2 depicts a servoactuator, generally indicated at 42, incorporating the improved seal assembly 43. In this form, the servoactuator is shown as again incorporating a five-piece body, again indicated at 11, which again includes parts 15,16,18,19,20, respectively. A servovalve, again indicated at 26, is operatively arranged to control the flow of fluid to actuator chambers 24,25 via passageways 28,29, respectively. A rod 44 extends leftwardly from piston 12, and a rod 45 extends rightwardly from piston 12. Rod 44 is shown as having an inner portion 44A arranged within actuator chamber 24, a penetrant portion 44B passing through end wall opening 21, and an outer portion 44C arranged outside the actuator. Rod inner and penetrant portions 44A,44B have a diameter $d_p$, while rod outer portion 44C has a diameter $d_r$. Thus, rod portions 44B and 44C define a leftwardly-facing annular vertical surface 46. The area of this surface ($A_{46}$) is selected so that it equals the effective pumping area of the bellows ($A_{bellow\ eff}$). Or, $$A_{46} = A_{bellows\ eff} \quad [3]$$

$$A_{46} = \frac{\pi}{4} [d_p^2 - d_r^2] \quad [4]$$

The improved seal assembly is also shown as having a bellows, again indicated at 38. The left end of this bellows is secured to body left part 15, and its right end is secured to the sliding-seal member 30. Note that frictional member 36 has been omitted, and that the sliding-seal member sealingly and frictionally engages the rod outer part via O-ring 35. A high-pressure laminar-type seal, having an alternating series of lands-and-grooves (40), is provided between the body end wall and the rod penetrant portion. A low-pressure seal is provided between the sliding-seal member and the rod outer portion. A flexible closure, such as bellows 38, engages the body and the sliding-seal member. Thus, the bellows, the body, the sliding-seal member and the rod define a leakage chamber 48 to the immediate left of the wall opening. Pressurized fluid in chamber 24 will therefore leak between the end wall opening and the penetrant portion of the rod into leakage chamber 48. The pressure in the leakage chamber is limited by the return relief valve to a value capable of driving the sliding-seal member leftwardly to abut stop 33 against the opposing bellows spring force. However, unlike the prior art embodiment, the improved design permits equal small-amplitude exercising motion of the rod relative to the body within displacement limits, without occasioning a volumetric change of leakage chamber 48. Thus, during such normal exercising motion, the pressure within leakage chamber 48 is independent of the specific position of the rod and sliding-seal member relative to the body. However, If the actuator piston rod is displaced more that the displacement of the sliding seal between its limit stops, the rod will slide through the seal member and the volume of the enclosed chamber will increase or decrease, depending on the direction or rod motion. If the volume decreases due to a rod extension, excess fluid will be discharged through relief valve 41. On the other hand, if the rod is retracted, causing the sliding-seal member to abut right stop 34, further motion of the rod will cause it to slide through the seal and to increase the enclosed volume. To maintain the hydrostatic coupling between the piston rod and the sliding seal, it is necessary that the enclosed volume be kept full of fluid. This is accomplished by a reverse flow check valve 49 which allows fluid to be drawn into the chamber through the return line.

The result of maintaining constant volume in the leakage chamber as the sliding seal moves with the rod is to effectively cause the seal member to be hydrostatically coupled to the rod. If the seal fails to move through the same displacement as the rod, the resulting volumetric change will cause a change in the leakage chamber pressure in a direction to urge the seal member to follow the rod. This, the primary function of the improved seal assembly is to minimize wear between the sliding-seal member and the rod in a manner not dependent on friction.

Modifications

The present invention contemplates that many changes and modifications may be made. For example, in the disclosed forms, the piston rods are shown as having equal diameters. This is merely so that the piston will have equal-area surfaces facing into the actuator chambers. This need not invariably obtain. In an appropriate case, the diameter of the piston rods may be different. Indeed, one rod may be omitted altogether, if desired. The body may be formed to other shapes as well. While the invention is intended to be used with a fluid-powered actuator, it is not necessary that a servovalve control the flow of fluid with respect to one or both actuator chambers.

Therefore, while the presently-preferred embodiment of the improved seal assembly has been shown and described, and several modifications and changes thereof discussed, persons skilled in this art will readily appreciate that various additional changes and modifications may be made without departing from the spirit of the invention as defined and differentiated by the following claims.

What is claimed is:

1. In a fluid-powered actuator having a body and a rod, said body having a portion configured as an end wall provided with a through-opening, said rod having an inner portion arranged on one side of said end wall in a pressurizable working chamber of said actuator, having a penetrant portion passing through said end wall opening, and having an outer portion arranged on the other side of said end wall, said actuator also including a seal assembly for containing fluid leaking from said actuator chamber between said rod penetrant portion and said wall opening, said seal assembly having a sliding-seal member engaging said rod outer portion for sealed movement therewith and for sealed sliding movement therealong toward and away from said rod penetrant portion, and a flexible closure joining said body and said sliding-seal member and defining between said body, said sliding-seal member and said rod, a leakage chamber surrounding said end wall opening, the improvement which comprises:

said rod being configured such that the transverse cross-sectional area of said penetrant portion is greater than the transverse cross-sectional area of said outer portion so as to define an annular surface therebetween; and wherein said rod and said flexible closure are so dimensioned, configured and arranged relative to one another such that equal small-amplitude movements of said rod and said sliding-seal member relative to said body will not substantially change the volume of said leakage chamber;

whereby said seal assembly may accommodate such small-amplitude movements of said rod relative to said body without causing said sliding-seal member to move relative to said rod.

2. The improvement as set forth in claim 1, and further comprising:

a resilient member acting between said body and said sliding-seal member for urging said sliding-seal member to move toward said annular surface.

3. The improvement as set forth in claim 2 wherein said resilient member is a bellows.

4. The improvement as set forth in claim 2 wherein said resilient member exerts a force on said sliding-seal member to create a pressure in said leakage chamber.

5. The improvement as set forth in claim 4, and further comprising:

a pressure relief valve operatively arranged to permit fluid to exit from said leakage chamber whenever the pressure in said leakage chamber exceeds a predetermined pressure.

6. The improvement as set forth in claim 5 wherein said sliding-seal member has a range of motion relative to said body, and wherein said predetermined pressure is less than the pressure that would be required to move said sliding-seal member away from said end wall to the limit of said displacement range.

7. The improvement as set forth in claim 1 wherein said body and rod penetrant portion have closely-spaced facing metal-to-metal surfaces which define a laminar seal between said body and said rod.

8. The improvement as set forth in claim 3 wherein said bellows surrounds said rod outer portion, wherein said bellows has an effective piston area, and wherein said bellows piston area minus the cross-sectional area of said rod outer portion is substantially equal to the area of said annular surface.

9. In a fluid-powered actuator having a body and a rod, said body having a portion configured as an end wall provided with a through-opening, said rod having an inner portion arranged on one side of said end wall in a pressurizable working chamber of said actuator, having a penetrant portion passing through said opening, and having an outer portion arranged on the other side of said end wall, the improvement which comprises:

a seal assembly for containing fluid leaking from said actuator chamber between said rod penetrant portion and said end wall opening, said seal assembly including:

a sliding-seal member engaging said rod outer portion for sealed movement therewith and for sealed sliding movement therealong; and a flexible closure having one end connected to said body and having another end connected to said sliding-seal member to define between said body, said sliding-seal member and said rod a sealed chamber communicating with said end wall opening, said flexible closure being movable relative to said body within a displacement range; and wherein said rod has an annular surface and is so configured, dimensioned and arranged relative to said flexible closure that the pressure in said sealed chamber remains substantially constant within said displacement range during small-amplitude motion of said rod relative to said body.

10. The improvement as set forth in claim 9 wherein the volume of said sealed chamber remains substantially constant when said sliding-seal member and rod move through substantially-equal small-amplitude motions relative to said body.

11. The improvement as set forth in claim 9 wherein the frictional forces between said sliding-seal member and said rod outer portion are less than the forces normally required to move said flexible closure throughout said displacement range.

12. In a fluid-powered actuator having a body and a rod, said body having a portion configured as an end wall provided with a through-opening, said rod having an inner portion arranged on one side of said end wall in a pressurizable working chamber of said actuator, having a penetrant portion passing through said opening, and having an outer portion arranged on the other side of said end wall, the improvement which comprises:

a seal assembly having a high-pressure seal arranged between said body and said rod penetrant portion, and having a low-pressure resilient sliding-seal mounted on said rod outer portion, said low-pressure seal being connected to said body by a flexible bellows arranged to form a low-pressure leakage chamber surrounding said end wall opening and adapted to permit small-amplitude reciprocating motion of said sliding-seal member relative to said body within displacement limits;

wherein said rod has an annular surface facing into said low-pressure chamber, said annular surface having an area substantially equal to the effective hydraulic pumping area between said bellows and said rod outer portion such that said sliding-seal will move with said rod within said displacement limits with substantially no change in the volume of said low-pressure chamber;

whereby said sliding-seal will be hydrostatically urged to move with said rod within said displacement limits, but said rod will move relative to said sliding-seal if the amplitude of rod motion exceeds said displacement limits.

* * * * *